US006412777B1

(12) United States Patent
Rossi

(10) Patent No.: US 6,412,777 B1
(45) Date of Patent: Jul. 2, 2002

(54) DOUBLE-STANDARD DWI-RULES GAME

(76) Inventor: Emil Richard Rossi, 18 Mayfair Ct., Little Silver, NJ (US) 07739

( * ) Notice: Subject to any disclaimer, the term of this patent is extended or adjusted under 35 U.S.C. 154(b) by 0 days.

(21) Appl. No.: 09/728,369

(22) Filed: Dec. 4, 2000

(51) Int. Cl.[7] ..... A63F 3/00
(52) U.S. Cl. ..... 273/243; 273/292; 273/252
(58) Field of Search ..... 273/236, 242, 273/243, 246, 248, 252, 254, 256, 259, 268, 292

(56) References Cited

U.S. PATENT DOCUMENTS 4,216,966 A 8/1980 MacRae
4,889,344 A * 12/1989 Zimba
4,953,871 A 9/1990 Antwi
5,071,134 A * 12/1991 Burroughs
5,121,928 A * 6/1992 Salerno
5,749,580 A 5/1998 Lopez
5,810,358 A * 9/1998 Manson
5,918,882 A * 7/1999 Truong
6,322,076 B1 * 11/2001 Fikki

* cited by examiner

*Primary Examiner*—Benjamin H. Layno
*Assistant Examiner*—Vishu K Mendiratta
(74) *Attorney, Agent, or Firm*—Tod A. Myrum

(57) ABSTRACT

A game for a multitude of players based on driving rules applied according to a player's social status. The game has a playing field and a segmented path, disposed on the playing field, the path including a set of indicia-bearing segments. The game has a multitude of tokens, each of the tokens for marking one player's path segment. The game has a first provision for issuing player-directives in response to the path indicia and a second provision for issuing player-directives in response to the directives issued by the first provision. The game has a provision for assigning each player indicia-bearing segments for starting and ending the game and a provision for assigning each player at least one game role. The game has a third provision for issuing player-directives for altering directives issued by the first and second provisions, a provision for temporarily positioning the tokens according to player directives issued by the second provision, and a provision for recording player-directives.

45 Claims, 7 Drawing Sheets

FIG. 8

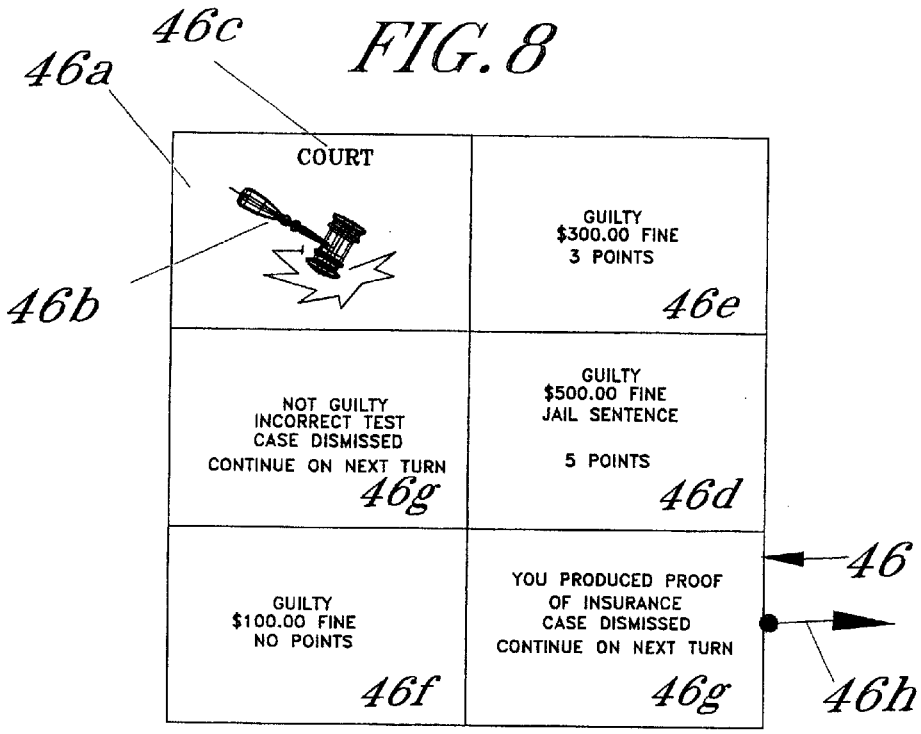

FIG. 9

48

MANDATORY PENALTIES & SENTENCES INCLUDING SUGGESTED LAWYERS FEEs

FOR ALCOHOL RELATED ( DWI or DUI ) OFFENSES

| DWI OFFENSE 48b | LICENSE LOSS 48f | 48d FINES | 48d FEES | 48d SUR-CHARGES | IMPRISON-MENT 48c | COMMUNITY SERVICE (CS) IDRC or DETAINMENT 48e | SUE & SUE LAW FIRM FEE 48a |
|---|---|---|---|---|---|---|---|
| DWI FIRST OFFENSE | 6 MOUNTHS<br>MISS ONE TURN | $250 FINE,$ 75 PER day IDRC fee ,$ 100 Drunk Driving Fund; $ 1000 Insurance surcharge IF GUILTY PAY THE THE ABOVE $$$$ TO THE DESIGNATED PLAYERS | | | Up to 30 days<br>SEE RULES FOR GETTING OUT OF JAIL | 2 Days IDRC = $250.00<br>ROLL DICE TO ESTAB # OF SPACES TO TO BACKUP | $ 1000.00<br>$1000.00 FOR FILEING AN APPEAL |
| DWI SECOND OFFENSE | 1 YEAR<br>MISS TWO TURNS | $500 FINE,$ 100 PER day IDRC fee ,$ 100 Drunk Driving Fund; $ 1500 Insurance surcharge IF GUILTY PAY THE THE ABOVE $$$$ TO THE DESIGNATED PLAYERS | | | Up to 90 days<br>SEE RULES FOR GETTING OUT OF JAIL | 4 Days IDRC=$ 500.00<br>ROLL DICE TO ESTAB # OF SPACES TO TO BACKUP | $ 2000.00<br>$1500.00 FOR AN APPEAL |
| DWI THIRD OFFENSE<br>NOTE: IF CONVICTED AND YOU LOST YOUR APPEAL YOU ARE OUT OF THE GAME | 10 YEARS<br>TRY AGAIN NEXT GAME | $1000 FINE,$ 100 PER day IDRC fee ,$ 100 Drunk Driving Fund; $ 1000 Insurance surcharge | | | Up to 180 days<br>SEE RULES FOR GETTING OUT OF JAIL | 5-days<br>IDRC=$ 1000.00<br>ROLL DICE TO ESTAB # OF SPACES TO TO BACKUP | $ 2500.00<br>$2000.00 FOR FILEING AN APPEAL<br>AN APPEAL<br>ROLL DICE TO ESTABLISH IF THE APPEAL IS SUCESSFUL<br>ODD# = YES<br>EVEN # == NO<br>OR<br>$$ = YES<br>DWI / DWI = NO |

54

PLAYERS DRIVING RECORD

| NAME | DWI s OR DUIs 54a | # OF POINTS 54b | $$$ AMOUNT OF FINES 54c | AMMOUNT OF COMMUNITY SERVICE # OF DAYS 54d | ALCOHOL TREATMENT PROGRAM 54f | GUILTY OR NOT GUILTY 54e |
|---|---|---|---|---|---|---|
| | | | | | | |
| | | | | | | |
| | | | | | | |
| | | | | | | |
| | | | | | | |
| | | | | | | |
| | | | | | | |
| | | | | | | |

NOTE: IF A PLAYER ACCUMULATES 3 DWI's DURING S/HIS DESTINATION RUN PLAYER IS OUT OF THE GAME

FIG. 12

58a

58b

GAME PLAYER

INSURANCE COMPANY EXECUTIVE

58e

THE BEARER OF THIS CARD
IS ENTITLED TO REAP THE
FINANCIAL REWARDS DUE TO
INSURANCE INDUSTRY LOBBYING
TO PASS LEGISLATION
SUCH AS:
STATE REQUIRED AUTOMOBILE INSURANCE
INSURANCE SURCHARGES
MINIMUM INSURANCE REQUIREMENTS

LAW FIRM OF SUE & SUE ESQ.

58f

THE BEARER OF THIS CARD
IS ENTITLED TO REAP
FINANCIAL REWARDS FOR
DEFENDING LAWBREAKING MOTORISTS
AGAINST SEVERE PENALTIES
IMPOSED FOR BREAKING DMV LAWS
LOBBYIED FOR BY THE VARIOUS
SPECIAL INTREST GROUPS

58g

CONSTRUCTION WORKER

THE BEARER OF THIS CARD
IS NOT ENTITLED TO ANY DMV
PRIVILEGES WHILE OPERATING A
MOTOR VEHICLE

"DWIE"

58c

THIS IS A DRIVER WHO

HAS HAD NUMERIOUS THAFFIC CITATIONS
WHO ALWAYS HAPPENS TO BE IN THE
WRONG PLACE AT THE WRONG TIME
DRIVING A BEAT UP UNSAFE VEHICLE
AND HAS HIS FIRST "DWI" CONVICTION

58d

BANKER
GAME FACILITATOR

THE BEARER OF THIS CARD
- IS ENTITLED TO COLLECT ALL FINES & MONEYS LEVIED AGAINST PLAYERS
EXCEPT MONEYS TO THE INDIVIDUAL GAME PLAYERS
( LAWYER,STATE,INSURANCE,POLITIAN )
- DISPENSES $$$ AWARDS TO PLAYERS
RECORD PLAYERS DRIVING RECORDS

58

FIG. 13

60a

60b

HELPING HAND

60c

2000
XYZ COUNTY
ASSOCIATION OF
CHIEFS
OF POLICE

DRIVE SAFELY!
SAVE A LIFE!

PRINCIPLES
THE BEARER OF THIS SAFETY CARD HAS BEEN CITED AS A SAFE AND COURTEOUS DRIVER OF MOTOR VEHICLES AND IS PLEDGED TO COOPERATE WITH THE POLICEMENS BENEVOLENT ASSOCIATION IN THEIR SAFE AND COURTEOUS DRIVING CAMPAIGN.THIS CARD IS SUBJECT TO FORFEITURE FOR ANY VIOLATION OF THE MOTOR VEHICLE LAWS OF THIS STATE
IN OTHER WORDS
CAN BE USED TO AVOID TICKET

XYZ COUNTY 200 CLUB
MEMBERSHIP CARD

60c

BUSINESS SUPPORTER
THE BEARER OF THIS CARD IS ENTITLED TO
COURTEOUS TREATMENT DUE TO HIS SUPPORT FOR
KILLED OR INJURED IN THE LINE OF DUTY
IN OTHER WORDS
CAN BE USED TO AVOID TICKET

STATE POLICEMEN"S
BENEVOLENT ASSOCIATION

60c

STATE
P.B.A.

JOHN SMITH
PRESIDENT
DRIVE SAFELY!
SAVE A LIFE! 2000

PRINCIPLES
THE BEARER OF THIS SAFETY CARD HAS BEEN CITED AS A SAFE AND COURTEOUS DRIVER OF MOTOR VEHICLES AND IS PLEDGED TO COOPERATE WITH THE POLICEMENS BENEVOLENT ASSOCIATION IN THEIR SAFE AND COURTEOUS DRIVING CAMPAIGN.THIS CARD IS SUBJECT TO FORFEITURE FOR ANY VIOLATION OF THE MOTOR VEHICLE LAWS OF THIS STATE
IN OTHER WORDS
CAN BE USED TO AVOID TICKET

60d

THE BEARER OF THIS CARD CAN USE IT TO
PROOVE THAT SOMEONE ELSE USED HIS
DRIVERS LICENSE WHEN GETTING A DWI
DWI IS DISMISSED
USE TT PAY LAWYER FEE $500.00

THE BEARER OF THIS CARD
USUALLY USED BY A LAW OFFICER'S OR THOSE
POLITICALLY CONNECTED TO CONVENIENTLY
MISPLACE HIGH BREATHALYZER EVIDENCE
LACK OF EVIDENSE AT TRIAL
DWI IS DISMISSED
USE TT PAY LAWYER FEE $500.00

60d

60e

60

DOUBLE-STANDARD DWI-RULES GAME

BACKGROUND OF THE INVENTION

The present invention relates to games and game playing. More particularly, the present invention relates to a game based on drunk-driving rules and other rules of the road, the financial consequences of drunk driving, and the different ways of applying drunk-driving rules and other rules of the road according social status.

The object of the game disclosed herein, is to provide amusement for the players while they acquaint themselves with the financial liability incurred by being arrested for driving drunk. It is also is an object of the game is to provide amusement for the players while they acquaint themselves with the behind the scene manipulations resulting in special treatment for drunk-driving offenders according to their social status.

SUMMARY OF THE INVENTION

Embodiments of the present invention provide a game for a multitude of players based on driving rules applied according to a player's social status. The game has a playing field and a provision disposed on the playing field for traversing the playing field. The traversing provision has a multitude of discrete positions, including a set of indicia-bearing discrete positions and a set of non-indicia-bearing discrete positions. The game has a provision for identifying the discrete position occupied by each player at each instant of play, a provision for exchanging and measuring fictitious value during play, and a first chance provision for randomly generating a plurality of numerical and non-numerical outcomes. The game has a first provision for issuing player-directives in response to indicia born by the set of indicia-bearing discrete positions and a second provision for issuing player-directives in response to the directives issued by the first provision. The game has a provision for assigning each player discrete indicia bearing positions for starting and ending the game and a provision for assigning each player at least one game role. The game has a third provision for issuing player-directives for altering directives issued by the first and second provisions for issuing player-directives. The game has a provision, remote from the field traversing provision, for temporarily positioning the discrete-position-identifying provisions according to player directives issued by the second provision for issuing player directives. The game has a provision for recording player-directives.

BRIEF DESCRIPTION OF THE FIGURES

FIG. 8 presents the back and fronts of the fifth deck of cards of the preferred embodiment of the invented game, including examples of the possible fifth player-directives.

FIG. 9 presents the sixth player-directives of the preferred embodiment of the invented game.

FIG. 12 presents the back and fronts of the seventh deck of cards of the preferred embodiment of the invented game, including examples of the possible societal roles assigned to the game players.

FIG. 13 presents the back and fronts of the eighth deck of cards of the preferred embodiment of the invented game, including examples of the possible seventh player-directives.

DETAILED DESCRIPTION OF THE INVENTION

Figure 1:
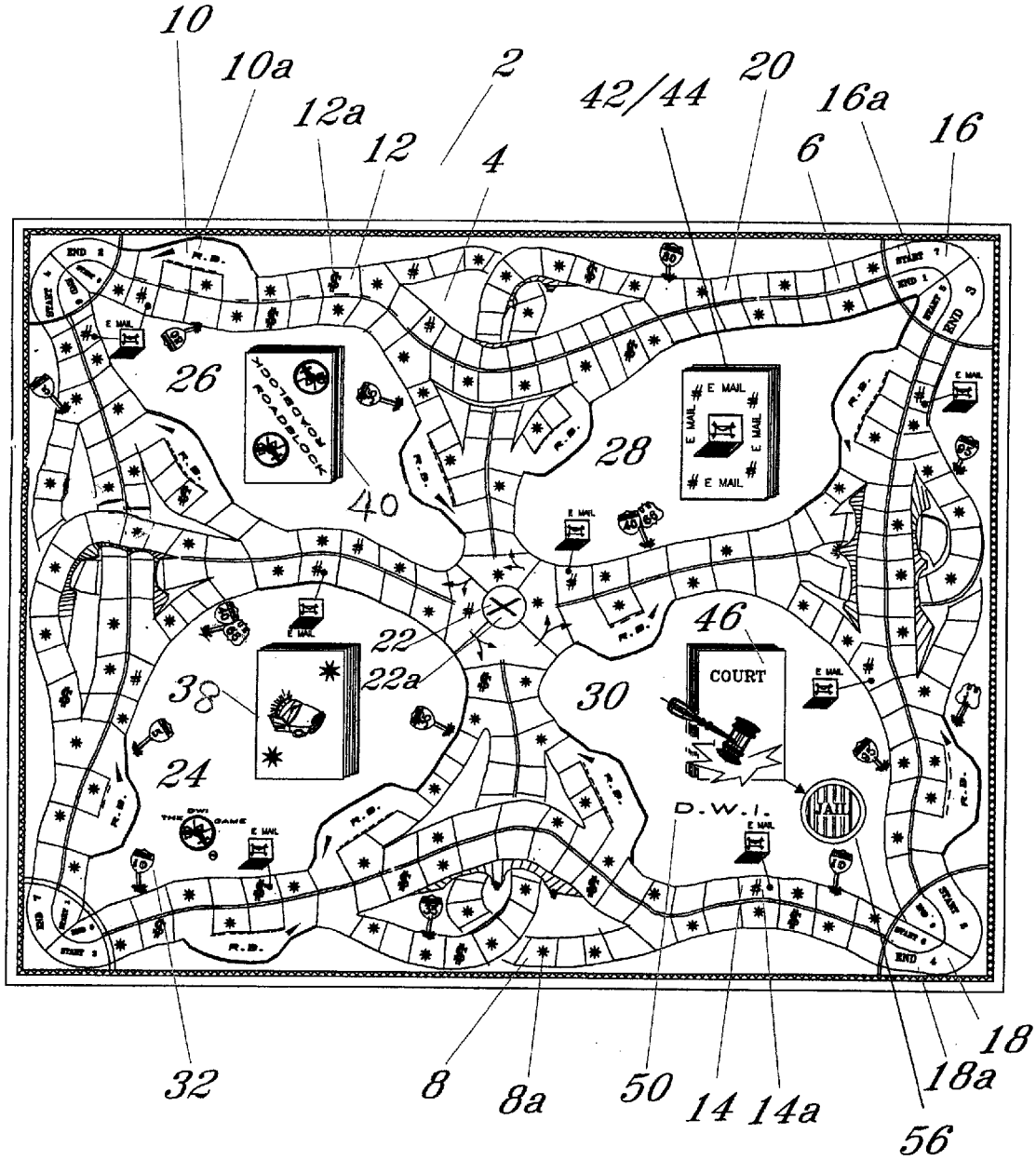
FIG. 1 is the playing field of the preferred embodiment of the invented game.

The preferred embodiment of the present invention is game 2, shown in FIG. 1. Game 2 is preferably configured as a typical board game having a playing board (not shown) of any type commonly used for board games. Game 2 includes playing field 4 that forms the top surface of the playing board. Alternatively, playing field 4 may be a flexible sheet, having a thickness less than that of the playing board, of any suitable material, such as plastic, cloth, etc., that may be temporarily positioned atop a smooth, flat surface, such a table-top. In another alternative, playing field 4 may be the display on a computer monitor or television screen. Playing field 4 is preferably a parallelogram, such as a square or rectangle. The rectangular shape is exemplified in FIG. 1.

Game 2 has a means, disposed on the playing field, for traversing the playing field having a multitude of discrete positions, including a set of indicia-bearing discrete positions and a set of non-indicia-bearing discrete positions. The traversing means is preferably a path having a plurality of path segments, preferably as exemplified by path 6 in FIG. 1. Path 6 is preferably reminiscent of a freeway system. The plurality of path segments have a first set of path segments, as demonstrated by path segment 8, bearing first indicia, preferably asterisks, as exemplified by indicium 8*a*.

The plurality of path segments have a second set of path segments, as demonstrated by path segment 10, bearing second indicia, preferably the initials R. B., as exemplified by indicium 10*a*.

The plurality of path segments have a third set of path segments, as demonstrated by path segment 12, bearing third indicia, preferably a dollar symbol ($), as exemplified by indicium 12*a*.

The plurality of path segments have a fourth set of path segments, as demonstrated by path segment 14, bearing a fourth indicium 14*a*, preferably a combination of indicium 12*a* and a symbol representing a notebook computer, as exemplified by indicium 14*a*.

The plurality of path segments have a fifth set of path segments having one start-segment, as demonstrated by start-segment 16, for each of the plurality of players, each start-segment bearing a unique start indicium, preferably the word "START" followed by a numerical value, as exemplified by indicium 16*a*. The plurality path segments have a sixth set of path segments having one end-segment, as demonstrated by end-segment 18, for each of the plurality of players, each end-segment bearing a unique end indicium, preferably the word "END" followed by a numerical value, as exemplified by indicium 18*a*. Note that the start- and end-segments are preferably located in each of the corners of playing surface 4, with a start-segment preferably located adjacent an end segment, as demonstrated by the start- and end-segments 16 and 18, respectively. Preferably there are at least two start-segments and two end-segments per corner, giving a total of at least at least eight start- and eight end-segments. Therefore, the numerical values of indicium 16*a* and 18*a* are both in the range from one (1) to at least eight (8).

The plurality of path segments have a set of blank path segments, demonstrated by path segment 20, and a center path segment, demonstrated by path segment 22, bearing a center indicium, preferably an X, as exemplified by indicium 22*a*, located at the center of playing field 4.

Playing field 4 also preferably includes regions 24, 26, 28, and 30, each region bounded by a portion of path 6, as shown in FIG. 1. Additional discussion of these regions will be presented in below, as appropriate. Playing field 4 may include common traffic signs, such as signs commonly used to display numbers of roads, as demonstrated by traffic sign 32.

Game 2 includes a means for exchanging and measuring fictitious value during play, preferably play money of at least the following denominations: $50.00, $100.00, $500.00, and $1000.00. Game 2 has a means for identifying the discrete position occupied by each player at each instant of play, preferably a plurality of tokens (not shown), one token for each player. The tokens may have any shape and be of any suitable material. Preferably, the tokens are miniature plastic automobiles that are color coded, so that each player gets a different colored token. Alternatively, the tokens may represent different types of vehicles, one type for each player, such as miniature automobiles, delivery vans, tractor-trailers, dump trucks, and the like. In another alternative, the tokens may be distinct icons on a computer monitor or television screen.

Game 2 has a first chance means for randomly generating a plurality of numerical and non-numerical outcomes, the plurality of numerical outcomes including at least one set of special numerical outcomes and the plurality of non-numerical outcomes including at least first, second, and third sets of non-numerical outcomes. As will become clear in the following discussion, the first chance means serves a variety of functions.

Figure 2:
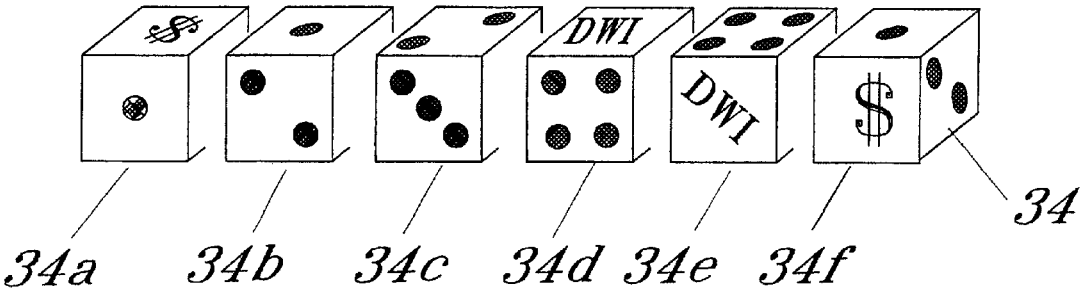
FIG. 2 shows the die faces of one die of the pair of dice of the preferred embodiment of the invented game.

Preferably the first chance means is a pair of dice. FIG. 2 displays the six die faces of each die, generally denoted by 34. FIG. 2 shows that the die has faces 34*a, b, c*, and *d* bearing indicia representing numerical values of one, two, three, and four, respectively. Die face 34*e* bears a fifth die indicium, preferably DWI. Die face 34*f* bears a sixth die indicium, preferably a dollar symbol ($).

Figure 3:
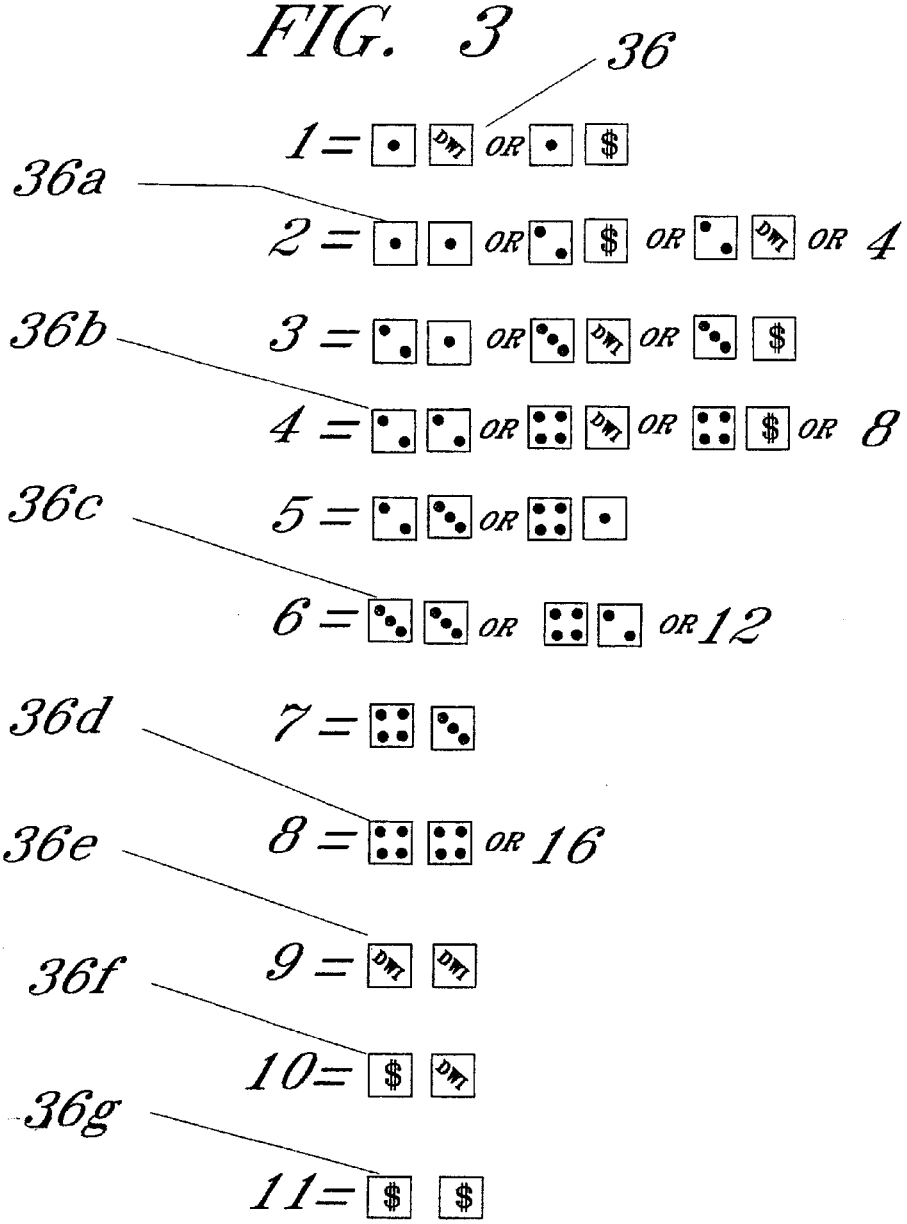
FIG. 3 shows the outcomes of the pair of dice of the preferred embodiment of the invented game.

FIG. 3 shows the possible numerical and non-numerical outcomes of the first chance means, as demonstrated using the preferred first chance means (the pair of dice), generally denoted by 36. The set of special numerical outcomes corresponds to rolling a pair of identical numerical indicia, as demonstrated by numerical outcomes 36*a, b, c*, and *d*. The first, second, and third sets of non-numerical outcomes include rolling a pair of DWI indicia, exemplified by non-numerical outcome 36*e*, a DWI and $ indicium exemplified by non-numerical outcome 36*f*, and pair of $ indicia, exemplified by non-numerical outcome 36*g*, respectively. Non-numerical outcomes 36*e, f*, and *g* take on the numerical values of nine, ten, and eleven, respectively, as shown in FIG. 3 as appropriate. Alternatively, the first chance means may be a spinner having the numerical and non-numerical outcomes of the first chance means thereon. The first chance means may be a random generator, similar to random number generators used by computers, to randomly generate the numerical and non-numerical outcomes of the first chance means.

Game 2 has a first means for issuing player-directives in response to the indicia born by the set of indicia-bearing discrete positions. The first means for issuing player-directives preferably includes a second chance means for randomly issuing a player a first player-directive from a plurality of distinct first player-directives, the plurality of distinct first player-directives including at least first, second, and third types of first player-directives.

Figure 4:
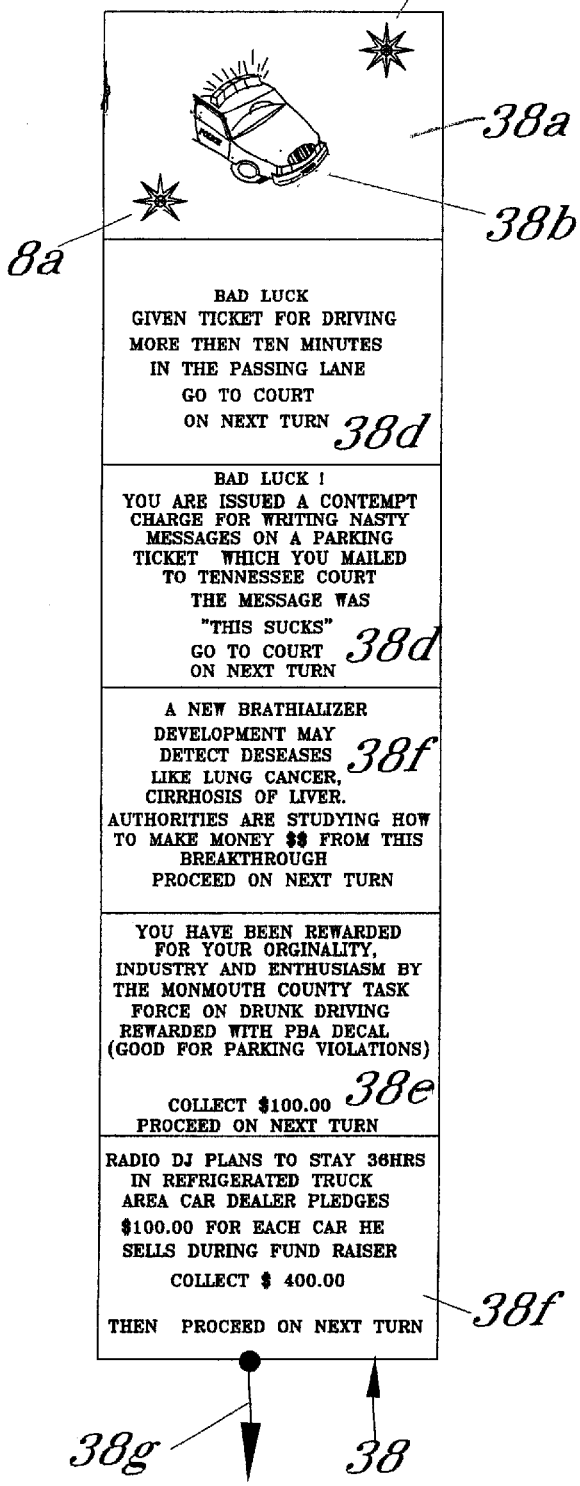
FIG. 4 presents the back and fronts of the first deck of cards of the preferred embodiment of the invented game, including examples of the possible first player-directives.

Preferably, the second chance means is a first deck of shuffled cards, demonstrated by deck 38 in FIG. 4. The backs, demonstrated by 38*a* in FIG. 4, of the cards of deck 38 bear indicia corresponding to the indicium 8*a* of path segment 8 and indicium 38*b*. Indicium 38*b* preferably includes the asterisks of indicia 8*a* and symbol representing the front of an automobile, preferably a law enforcement automobile. Deck 38 is preferably positioned back up in region 24 of playing field 4, as in FIG. 1. The front of each card of deck 38 bears one of the distinct first player-directives, whereby the player whose token lands on a path segment having indicium 8*a* draws one card from deck 38 and follows the first player-directive.

FIG. 4 provides examples of the first (38*d*), second (38*e*), and third (38*f*) types of first player-directives appearing on the fronts of the cards of deck 38. First player-directive type 38*d* includes all first player-directives directing the player to go to court. First player-directive type 38*e* includes all first player-directives directing the player to collect a sum of play money. First player-directive type 38*f* includes all first player-directives other than 38*d* or *e*. Arrow 38*g* in FIG. 4 is provided to indicate that the number of cards constituting each of first player-directive types 38*d, e*, and *f* is at least enough to make the drawing of a given card statistically random.

Alternatively, the second chance means may be a spinner having a distribution of at least first, second, and third types of first player-directives, such that the assignment of a given first player-directive type is statistically random. The second chance means may be a random generator, similar to random number generators used by computers, to randomly generate at least the first, second, and third types of first player-directives of the second chance means.

The first means for issuing player-directives also has a third chance means for randomly issuing a player a second player-directive from a plurality of distinct second player-directives, the plurality of distinct second player-directives including at least first, second, and third types of second player-directives.

Figure 5:
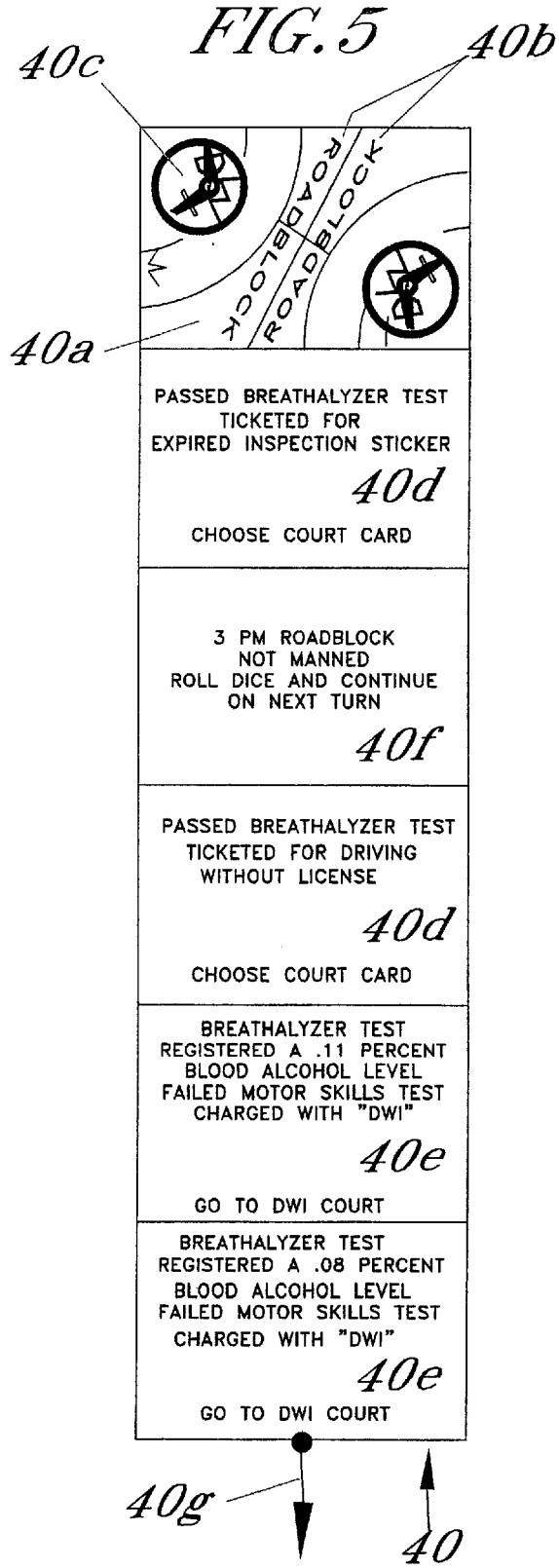
FIG. 5 presents the back and fronts of the second deck of cards of the preferred embodiment of the invented game, including examples of the possible second player-directives.

Preferably, the third chance means is a second deck of shuffled cards, demonstrated by deck 40 in FIG. 5. The backs, demonstrated by 40*a* in FIG. 5, of the cards of deck 40 bear indicia corresponding to the indicium 10*a* of path segment 10. As demonstrated in FIG. 5, card-back 40*a* preferably includes indicium 40*b* (ROADBLOCK), corresponding directly to indicia 10*a* (R.B.) in FIG. 1. Card-back 40*a* also preferably includes indicium 40*c*, as shown in FIG. 5. The deck is preferably positioned back up in region 26 of playing surface 4, as in FIG. 1. The front of each card of deck 40 bears one of the distinct second player-directives, whereby the player whose token lands on a path segment having indicium 10*a* draws one card from deck 40 and follows the second player-directive.

FIG. 5 provides examples of the first (40*d*), second (40*e*), and third (40*f*) types of second player-directives appearing on the fronts of the cards of deck 40. Second player-directive type 40*d* includes all second player-directives directing the player to go to court. Second player-directive type 40*e* includes all second player-directives directing the player to go to DWI court. Second player-directive type 40*f* includes all second player-directives other than 40*d* or *e*. Arrow 40*g* in FIG. 5 is provided to indicate that the number of cards constituting each of second player-directive types 40*d, e,* and *f* is at least enough to make the drawing of a given card statistically random.

Alternatively, the third chance means may be a spinner having a distribution of at least first, second, and third types of second player-directives, such that the assignment of a given second player-directive type is statistically random. The third chance means may be a random generator, similar to random number generators used by computers, to randomly generate at least the first, second, and third types of second player-directives of the third chance means.

The first means for issuing player-directives also has a fourth chance means for randomly issuing a player a third or fourth player-directive from a plurality of distinct third and fourth player-directives. The plurality of distinct third player-directives includes at least first and second types of third player-directives, and the plurality of distinct fourth player-directives includes at least first, second, and third types of fourth player-directives.

Preferably, the fourth chance means includes third and fourth decks of cards. The third deck of cards is demonstrated by deck 42 in FIG. 6. The backs, demonstrated by 42*a* in FIG. 6, of the cards of deck 42 bear indicia corresponding to the indicium 12*a* of path segment 12, as shown in FIG. 1. As demonstrated in FIG. 6, card-back 42*a* preferably includes indicium 42*b*, which includes a pair of indicia 12*a* and a pair of anagrams for automatic teller machine (ATM). The front of each card of the third deck bears one of the distinct third player-directives.

Figure 6:
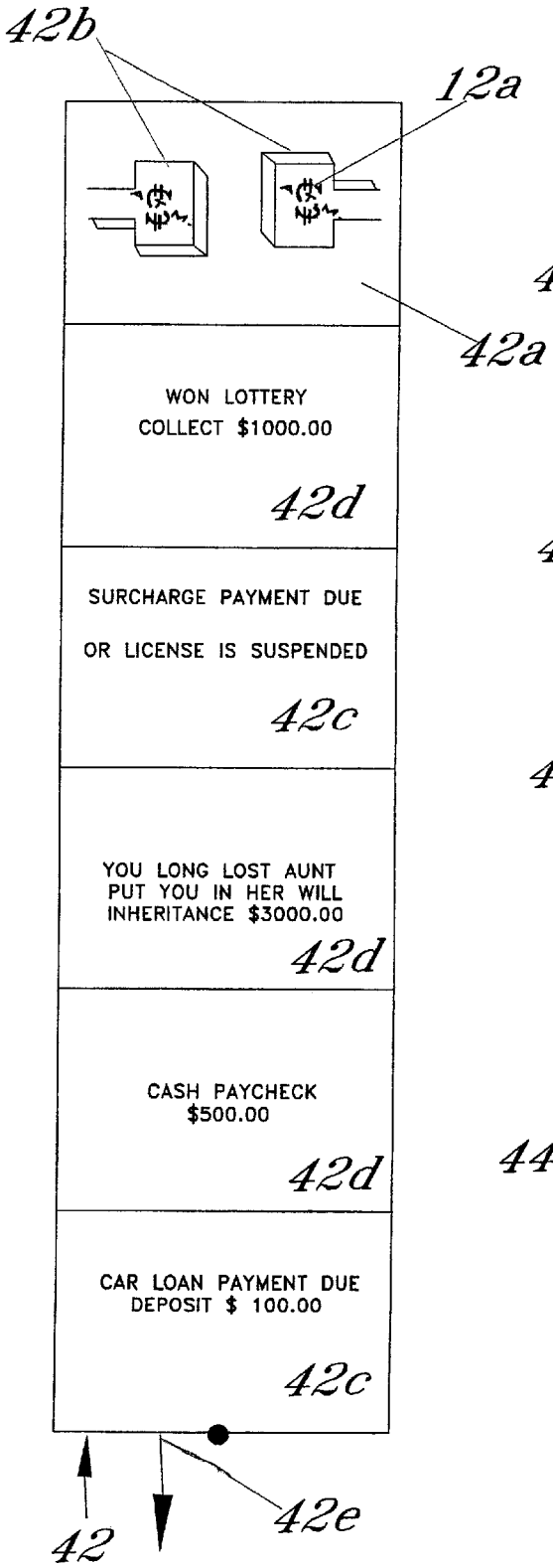
FIG. 6 presents the back and fronts of the third deck of cards of the preferred embodiment of the invented game, including examples of the possible third player-directives.

FIG. 6 provides examples of the first (42*c*) and second (42*d*) types of third player-directives appearing on the fronts of the cards of deck 42. Third player-directive type 42*c* includes all third player-directives that are detrimental to a player, whereas third player-directive type 42*d* includes all third player-directives that are beneficial to a player.

Figure 7:
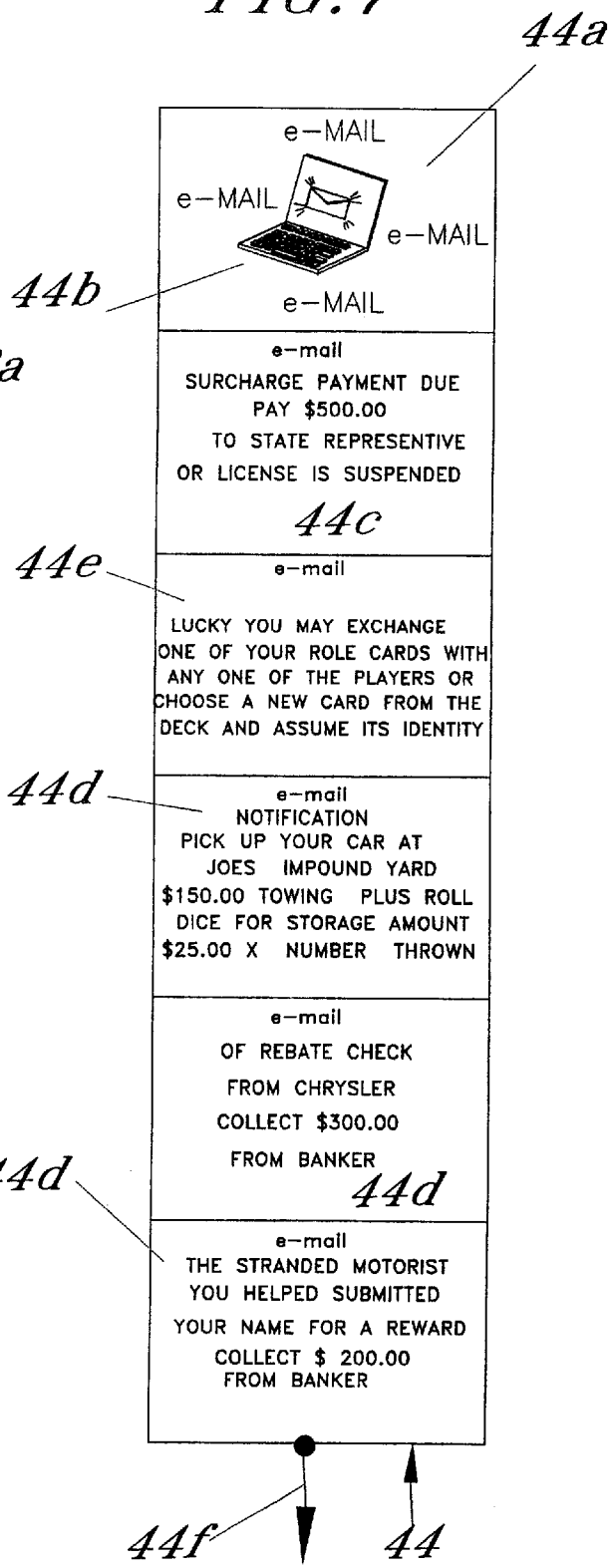
FIG. 7 presents the back and fronts of the fourth deck of cards of the preferred embodiment of the invented game, including examples of the possible fourth player-directives.

The fourth deck of cards is demonstrated by deck 44 in FIG. 7. The backs, demonstrated by 44*a* in FIG. 7, of the cards of deck 44 bear indicia corresponding to the indicium 14*a* of path segment 14, as shown in FIG. 1. As demonstrated in FIG. 7, card-back 44*a* preferably includes indicium 44*b*, the portion of indicium 14*a* that is a symbol representing a notebook computer. Card-back 44*a* also preferably includes indicium 44*c* e-MAIL, as shown in FIG. 7. The front of each card of the fourth deck bears one of the distinct fourth player-directives.

FIG. 7 provides examples of the first (44*c*), second (44*d*), and third (44*e*) types of fourth player-directives appearing on the fronts of the cards of deck 44. Fourth player-directive type 44*c* includes all fourth player-directives that are detrimental to a player, whereas fourth player-directive type 44*d* includes all fourth player-directives that are beneficial to a player. Fourth player-directive type 44*d* includes fourth player-directives directing the player to choose the option of changing at least one societal role with another player or of relinquishing at least one assigned societal role and obtaining at least one different societal role using a seventh chance means. Societal roles and the seventh chance means are discussed below.

Decks 42 and 44 are shuffled together to form a single mixed deck 42/44. Mixed deck 42/44 is preferably positioned back up in region 28 of playing surface 4, as in FIG. 1. When a player's token lands on a path segment having indicium 12*a* or 14*a*, the player draws one card from mixed deck 42/44 and follows either the third or fourth player-directive, as appropriate. Arrows 42*e* and 44*f*, in FIGS. 6 and 7, respectively, are provided to indicate that the number of cards constituting decks 42 and 44 is at least enough to make the drawing of a given card from mixed deck 42/44 statistically random.

Alternatively, the fourth chance means may be a spinner having a distribution of at least first and second types of third player-directives and at least first, second, and third types of fourth player-directives, such that the assignment of a given third or fourth player-directive type is statistically random. The fourth chance means may be a random generator, similar to random number generators used by computers, to randomly generate at least first and second types of third player-directives and at least the first, second, and third types of fourth player-directives of the fourth chance means.

Game 2 has a second means for issuing player-directives in response to the directives issued by the first means for issuing player directives. The second means for issuing player directives has a fifth chance means for randomly issuing a player a fifth player-directive from a plurality of distinct fifth player-directives, in response to the first type of first or second player-directives. The plurality of distinct fifth player-directives includes at least first, second, third, and fourth types of fifth player-directives.

Preferably, the fifth chance means is a fifth deck of shuffled cards, demonstrated by deck 46 in FIG. 8. The backs, demonstrated by 46*a* in FIG. 8, of the cards of deck 46 bear indicia 46*b* and *c*, preferably a hammer striking a blow and the word COURT, respectively. The deck is preferably positioned back up in region 30 of playing surface 4, as in FIG. 1. The front of each card of deck 40 bears one of the distinct fifth player-directives. When a player draws either first player-directive type 38*d* from deck 38 or second player-directive type 40*d* from deck 40, the player subsequently draws a card from deck 46 and follows the distinct fifth player-directive.

FIG. 8 provides examples of the first (46*d*), second (46*e*), third (46*f*), and fourth (46*g*) types of fifth player-directives, appearing on the fronts of the cards of deck 46. Fifth player-directive type 46*d* includes a guilty verdict, a fine, a jail sentence, and a number of points, which are assigned to the player. Fifth player-directive type 46*e* includes a guilty verdict, a fine, and a number of points, which are assigned to the player. Fifth player-directive type 46*f* includes a guilty verdict and a fine. Fifth player-directive type 46*g* includes a not-guilty verdict. Arrow 46*h* in FIG. 8 is provided to indicate that the number of cards constituting each of second player-directive types 46*d, e, f,* and *g* is at least enough to make the drawing of a given card statistically random.

Alternatively, the fifth chance means may be a spinner having a distribution of at least first, second, third, and fourth types of fifth player-directives, such that the assignment of a given fifth player-directive type is statistically random. The fifth chance means may be a random generator, similar to random number generators used by computers, to randomly generate at least the first, second, third, and fourth types of fifth player-directives of the third chance means.

The second means for issuing player directives also has a means for issuing a player a sixth player-directive from a plurality of distinct sixth player-directives, in response to the second type of second player-directives. The plurality of distinct sixth player-directives includes at least first and second types of sixth player-directives. The second type of sixth player-directive includes at least first, second, third, and fourth subtypes.

The means for issuing a player a sixth player-directive is preferably Table 48, exemplified in FIG. 9. Table 48 is used for a second player-directive type 40*e*, directing the player to go to DWI court. In fact, Table 48 is a simulation of DWI court, represented by indicium 50, preferably D.W.I., preferably located in region 40 of playing surface 4 of FIG. 1. FIG. 9 demonstrates the first (48*a*) and second (48*b*) types of the sixth player-directives. FIG. 9 also demonstrates the first (48*c*), second (48*d*), third (48*e*), and fourth (48*f*) subtypes of the second type of sixth player-directives (48*b*).

Sixth player-directive type 48*a* preferably includes the player paying a mandatory fee and the option of paying an additional fee, preferably called an appeal fee, the amounts of both fees increasing for increased numbers of sixth player-directive types 48*b*. Payment of the optional additional fee allows the player to use the first chance means (preferably the pair of dice) to randomly generate a numerical outcome. If the numerical outcome is odd the player does not receive a sixth player-directive. This corresponds to a not-guilty verdict. If the numerical outcome is even, the player receives sixth player-directive type 48*b*, a DWI offense. This corresponds to a guilty verdict.

Sixth player-directive subtype 48*c* directs the player to go to jail, getting out of jail becoming more difficult for increased numbers of sixth player-directive types 48*b*. Sixth player-directive subtype 48*d* preferably directs the player to pay fines, fees, and surcharges, the amount of each increasing for increased numbers of sixth player-directive types 48*b*. Sixth player-directive subtype 48*e* preferably assigns numbers of community service days and/or days in an alcohol treatment program and directs the player to pay a fee based on the number of days. Subtype 48*e* also directs the player to use the first chance means (preferably the pair of dice) to randomly generate a numerical outcome to establish the number of spaces the player's token is moved in the opposite direction of normal movement. The number of community service days for sixth player-directive subtype 48*e* increases for increased numbers of sixth player-directive types 48*b*. Sixth player-directive subtype 48*f* directs the player to miss at least one turn; the number of missed turns increasing for increased numbers of sixth player-directive types 48*b*.

Alternatively, the above-described functions of Table 48 can be accomplished using suitable computer software.

Game 2 has a means for assigning each player discrete indicia bearing positions for starting and ending the game, preferably a sixth chance means for randomly assigning each player, at the start of the game, a path segment for starting the game and a path segment for ending the game. Preferably, the sixth chance means is a sixth deck of shuffled cards, demonstrated by deck 52 in FIG. 10. The backs, demonstrated by 52*a* in FIG. 10, of the cards of deck 52 bear indicium 52*b*, preferably including the words START & DESTINATION, in duplicate, and the letters S D.

The front of each card of the sixth deck bears an indicium, demonstrated by indicium 52*c*, corresponding to one of the start indicium 16*a* of one of the start-segments 16 and one of the end indicium 18*a* of one of the end-segments 18. Indicium 52*c* preferably includes an indicium identical to start indicium 16*a*. Indicium 52*c* also preferably includes DESTINATION followed by a numerical value, where DESTINATION corresponds to the END portion of indicium 18*a*. Indicium 52*c* specifies unique pair of start-end path segments for each player. Preferably, there are at least 64 distinct 52*c*-type indicia. Each player draws a card from deck 52 to establish each player's start-segment, where the player positions his/her token at the start of the game, and to establish each player's end-segment, where the player's token will be located at the end of the game.

Alternatively, the sixth chance means may be a spinner having at least 64 distinct 52*c*-type indicia. The fifth chance means may be a random generator, similar to random number generators used by computers, to randomly generate at least 64 distinct 52*c*-type indicia.

Game 2 has a means for players to record at least the second type of second player-directive, the first, second, and third types of fifth player-directives, the first and second types of sixth-player-directives, and the second and third subtypes of the second type of sixth-player-directives.

Figures 10, 11:
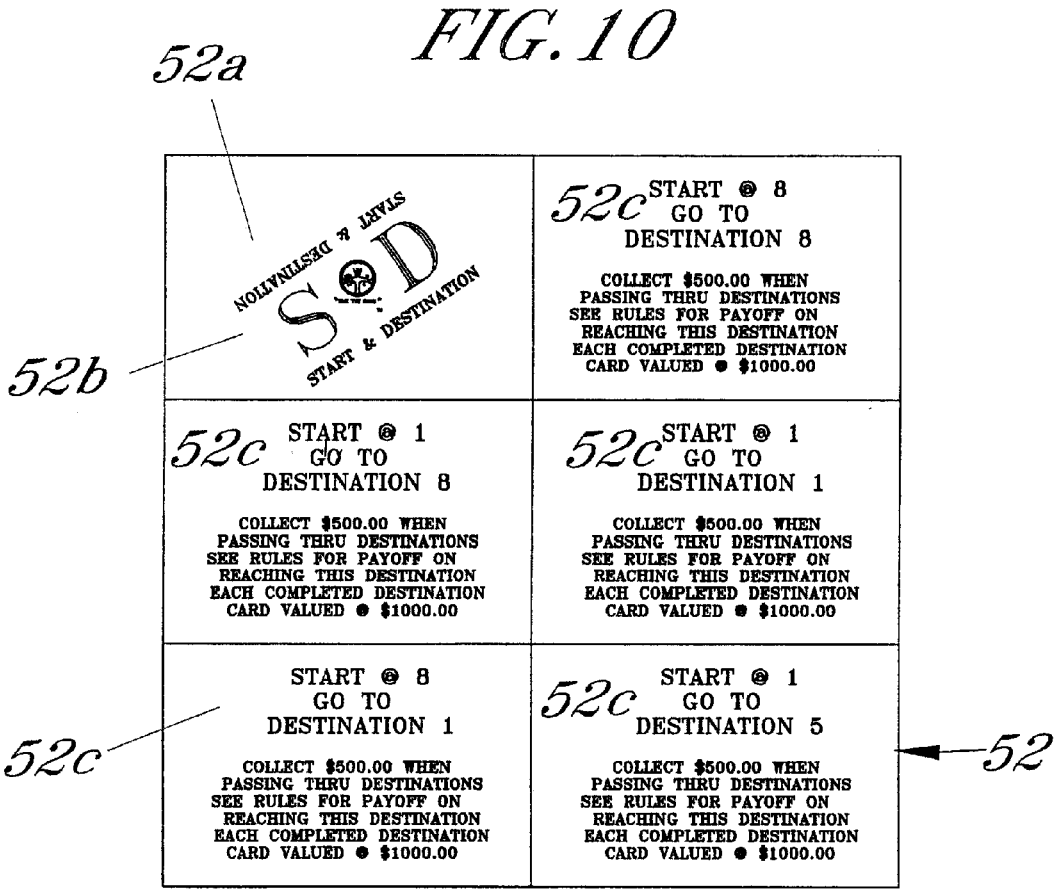
FIG. 10 presents the back and fronts of the sixth deck of cards of the preferred embodiment of the invented game, including examples of the possible start and end assignments.
FIG. 11 is an example of the recording device of the preferred embodiment of the invented game.

The recording means is preferably Table 54, demonstrated in FIG. 11. Table 54 represents a player's driving record. Table 54 includes column 54*a* for recording the second type of the second player-directives, preferably second player-directive type 40*e*, which includes all second player-directives directing the player to go to DWI court. Table 54 includes column 54*b* for recording the points assigned to a player by the second player-directive type of the fifth player-directives, preferably fifth player-directive type 46*e*. Table 54 includes column 54*c* for recording the fines assigned by the first, second, and third types of the fifth player-directives, preferably fifth player-directive types 46*d*, *e*, and *f*, respectively. Fines assigned by the second subtype of the second type of the sixth player-directives (48*b*), preferably sixth player-directive subtype 48*d*, are also recorded in column 54*c*. Table 54 includes column 54*d* for recording the number of community service days assigned by the third subtype of the second player-directive types of the sixth-player directives, preferably sixth player-directive subtype 48*e*. Table 54 includes column 54*e* for recording the guilty and not-guilty verdicts of the first type of the sixth player-directives, preferably sixth player-directive type 48*a*. Table 54 includes column 54*f* for recording the number of days to be spent in an alcohol treatment program assigned by the third subtype of the second player-directive types of the sixth-player directives, preferably sixth player-directive subtype 48*e*.

Alternatively, the recording means may be an electronic recording means capable of receiving inputs containing the information of the first, second, and third types of fifth player-directives, the first and second types of sixth-player-directives, and the second and third subtypes of the second type of sixth-player-directives. The recording means may be computer software.

Game 2 has a means, remote from the field traversing provision, for temporarily positioning the discrete-position-identifying provisions according to player directives issued by the second provision for issuing player directives. The temporary positioning means is preferably a jail, preferably denoted by indicium 56, which is preferably located in region 30 of playing surface 4, as shown in FIG. 1. The jail is used in response to the first type of fifth player-directives and the first subtype of the second type of the sixth player-directives, preferably fifth player-directive type 46*d* and sixth player-directive subtype 48*c*, respectively.

Game 2 has a means for assigning each player at least one game role, preferably a societal role. The game role assigning means is preferably a seventh chance means for randomly assigning each player at least one societal role. The seventh chance means preferably includes the above-described dice of the first chance means. The seventh chance means also preferably includes a seventh deck of cards.

The seventh deck is demonstrated by deck 58 in FIG. 12. Back 58*a* of each card of deck 58 preferably bears indicium 58*b* (GAME PLAYER). The fronts of the cards preferably include at least the specific different societal roles 58*c* (DWIE) and 58*d* (BANKER) and a number of other societal roles, as demonstrated by societal-roles 58*e–g*.

The player assigned societal role 58*c* preferably starts the game having at least one DWI preferably designated by the number one in column 54*a* of Table 54 in FIG. 11. The player assigned societal 58*c* also preferably starts the game having at least three points in column 54*b* of Table 54 in FIG. 11. The player assigned societal 58*d* starts the game with an additional sum of play money, preferably at least $10,000.00. Societal role 58*d* preferably includes the roles of game facilitator and judge. The judge uses Table 48 to issue the first (48*c*), second (48*d*), third (48*e*), and fourth (48*f*) subtypes of the second type of the sixth player-directives (48*b*), according to the number of DWI offenses (48*b*'s) possessed by a player.

Alternatively the seventh chance means may be a spinner having at least societal roles 58*c* and *d* and a number of other societal roles, as exemplified by societal roles 58*e–g*. In another alternative, the seventh chance means may be computer software.

Game 2 has a third means for issuing player-directives for altering directives issued by the first and second provisions for issuing player-directives. The third means is preferably an eighth chance means for randomly issuing a player at least one seventh player-directive from a plurality of distinct seventh player-directives. The seventh player-directives include directives corresponding to directives from the first type of first, second, third, fourth, fifth, and sixth player-directives. The seventh player-directives also include directives corresponding to directives from the second type of the second and fifth player-directives, the first, second, third, and fourth subtypes of the sixth player-directives, and the third type of fifth player-directives and directives for getting out of jail.

Preferably the eighth chance means is an eighth deck of shuffled cards, demonstrated by deck 60 in FIG. 13. The backs, demonstrated by 60*a* in FIG. 13, of the cards of deck 60 bear indicium 60*b*, preferably including the words HELPING HAND, in duplicate, and the letters H H. The front of each card of deck 60 bears one of the distinct seventh player-directives.

At the start of the game, each player draws at least one card from the eighth deck. After use, the card from the eighth deck is placed on the bottom of the eighth deck and another card is drawn from the top of the eighth deck, so as to have at least one card from the eighth deck during the entire game. If a player needs a particular card from the eighth deck he/or she may purchase the desired card from another player, if possessed by another player. Or, he/or she may trade, with another player, an eighth-deck card in his/or her possession for the desired card, if possessed by the other player.

FIG. 13 provides examples of the seventh player-directives appearing on the fronts of the cards of deck 60. Seventh player-directive 60*c* is an example of a seventh player-directive for negating first player-directive type 38*d* and second player-directive types 40*d, e*, and *f*. Seventh player-directive 60*d* is an example of a seventh player-directive for mitigating sixth player-directive type 48*a* of Table 48.

Arrow 60*e* in FIG. 13 is provided to indicate that the number of cards constituting deck 60 is at least enough to make the drawing of a given card statistically random.

Alternatively, the eighth chance means may be a spinner having a distribution of the different seventh player-directives, such that the assignment of a given second player-directive type is statistically random. The eighth chance means may be a random generator, similar to random number generators used by computers.

To play the preferred embodiment, game 2, of the present invention, each player selects a token from the plurality of tokens. Each player then preferably receives a Table 54 for recording the required information thereon. In the preferred method of play, each player records his/her own information on Table 54. A player caught falsifying information in Table 54 loses one turn for each offense. Alternatively, one of the players, such as the banker, may be designated to record each player's Table-54 information.

Each player is assigned at least one, but preferably two societal roles, by rolling the pair of dice to obtain one of the numerical values shown in FIG. 3. The player with the largest numerical value draws the card from deck 58 having societal role 58*d* and is thereby assigned the roles banker, game facilitator, and judge. The player having the lowest numerical value draws the card from deck 58 having societal role 58*c* and is thereby assigned the societal role of DWIE and correspondingly places the number one in column 54*a* and at least three points in column 54*b* of Table 54 in FIG. 11. Players having societal roles 58*c* and *d* are each assigned a second societal role by drawing one additional card, at random, from 58. Players having numerical values between the highest and lowest values each draw two cards, at random, from deck 58.

Players assigned societal roles other than 58*c* and 58*d*, as exemplified by societal roles 58*e, f*, and *g* of FIG. 12, preferably collect fees, surcharges, or the like that are assessed during play. These fees, surcharges, or the like are preferably paid to the player assigned the societal role corresponding to the given fee, surcharge, or the like. If no player is assigned that societal role, the fee is paid to the banker, the player assigned societal role 58*d*. For example, for the insurance surcharge of sixth player-directive subtype 48*d* of Table 48 in FIG. 9, the insurance surcharge is paid to the player assigned societal role 58*e*, exemplified in FIG. 12. If no player is assigned societal role 58*e*, the insurance surcharge is paid to the banker.

The banker then distributes an identical sum of play money to each player, preferably $10,000.00 as follows: 5 $1,000.00, 6 $500.00 15 $100.00, and 10 $50.00 denominations. The banker receives the same sum of play money as the other players plus an additional sum, preferably $10,000.00. Each player is then assigned a start-segment, as demonstrated by start-segment 16, and an end-segment, as demonstrated by end-segment 18, by drawing a card from deck 52 of FIG. 10. The player's token is positioned on the start segment at the start of the game. Reaching the assigned end segment is the player's objective during play. Each player now draws at least one card, but preferably four cards, from deck 60. Then, each player rolls the pair of dice to obtain one of the numerical values shown in FIG. 3 to determine the order in which the players start the game. The player having the highest numerical value goes first, the second highest numerical value second, etc. Note that for determining the order of play, non-numerical outcomes 36*e, f*, and *g* take on the numerical values of nine, ten, and eleven, respectively, as shown in FIG. 3.

During play each player's turn includes rolling the pair of dice and responding to the outcome of the roll. A player rolling one of the numerical outcomes of FIG. 3 moves the token the number of path segments, equal to the numerical outcome, toward the player's destination. If the player rolls one of numerical outcomes 3 6*a, b, c*, or *d* of FIG. 3, the player has the option of moving the number of path segments equal to the numerical outcome or moving the number of path segments equal to twice the numerical outcome. If the player rolls non-numerical outcome 36*e* of FIG. 3, the player is fined and loses a turn. If non-numerical outcome 36*f* is rolled, the player loses a turn, and if non-numerical outcome 36*g* is rolled, the player collects a sum of money, preferably $500.00, and has the option of rolling again.

During play, when a player's token lands on a path segment 8, the player draws a card from deck 38 of FIG. 4 and follows the player-directive on the front of the card. For a first player-directive type 38*d*, the player draws a card from deck 46. However, if the player is holding a card from deck 60, for negating first player-directive type 38*d*, the player has the option of playing the card from deck 60 to avoid drawing a card from the deck 46. If the player is not in possession of the proper deck-60 card, the player may obtain the proper deck-60 card from another player in exchange for play money or in exchange for another deck-60 card in his/her possession. The player then places the used deck-60 card on the bottom of deck 60, and draws another card from the top of deck 60.

When a player's token lands on a path segment 10, the player draws a card from deck 40 of FIG. 5 and follows the player-directive on the front of the card. For a second player-directive type 40*d*, the player draws a card from deck 46. For a second player-directive type 40*e*, the player places a mark in column 54*a* of Table 54, and Table 48 is used to assign the player sixth player-directive type 48*a* or *b*. However, if the player is holding a card from deck 60, for negating second player-directive type 40*d*, the player has the option of playing the card from deck 60 to avoid drawing a card from the deck 46. If the player is not in possession of the proper deck-60 card, the player may obtain the proper deck-60 card from another player in exchange for play money or in exchange for another deck-60 card in his/her possession. For a deck-60 card for negating second player-directive type 40*e*, the player has the option of playing the card from deck 60 to avoid to placing a mark in column 54*a* of Table 54 and to avoid Table 48. The player then places the used deck-60 card on the bottom of deck 60, and draws another card from the top of deck 60.

When a player's token lands one of the path segments 12 or 14, the player draws a card from mixed deck 42/44 and follows the directive. For third player-directive type 42*c* or fourth player-directive type 44*c*, the player has the option of playing a card from deck 60 to negate or mitigate third player-directive type 42*c* or fourth player-directive 44*c*, if the player is holding the appropriate card from deck 60. If the player is not in possession of the proper deck-60 card, the player may obtain the proper deck-60 card from another player in exchange for play money or in exchange for another deck-60 card in his/her possession. The player then places the used deck-60 card on the bottom of deck 60, and draws another card from the top of deck 60. For fourth player-directive type 44*d*, the player chooses the option of changing at least one societal role with another player or of relinquishing at least one assigned societal role and obtaining at least one different societal role by drawing a card from deck 58.

When a player draws a card from deck 46, the player has the option of negating or mitigating fifth player directives 46*d, e*, or *f* by playing a card from deck 60 that negates or mitigates the corresponding fifth player-directive, if the player possesses the appropriate deck-60 card. If the player is not in possession of the proper deck-60 card, the player may obtain the proper deck-60 card from another player in exchange for play money or in exchange for another deck-60 card in his/her possession. The player then places the used deck-60 card on the bottom of deck 60, and draws another card from the top of deck 60. For fifth player directives 46*d* or *e*, the player records the fine in column 54*c* of Table 54 and the number of points in column 54*b* of Table 54. For fifth player directives 46*f*, the player records the fine in column 54*c* of Table 54.

Using Table 48 to assign sixth player directive types 48*a* or *b* involves the player having societal role 58*d* (acting the part of judge) looking column 54*e* of the Table 54 possessed by the player having a second player-directive type 40*e* (the offender). If there are no guilty verdicts in column 54*e*, the judge assigns the offender a sixth player-directive type 48*a* for the first DWI offense, one guilty verdict the second DWI offense, and two guilty verdicts the third DWI offense. Sixth player-directive type 48*a* includes the player paying mandatory fee for the appropriate DWI offense, preferably the values given in Table 48 for sixth player-directive type 48*a*. Sixth player-directive type 48*a* also includes the option of paying an appeal fee for the appropriate DWI offense, preferably the values for appeal fees given in Table 48 for sixth player-directive type 48*a*. Payment of the optional appeal fee allows the player to use the pair of dice to generate a numerical outcome. The mandatory fee and the optional appeal fee are preferably paid to the player assigned societal role 58*f*, shown in FIG. 12. If no player is assigned societal role 58*f*, the mandatory fee and the optional appeal fee are paid to the banker, the player assigned societal role 58*d*. If the numerical outcome is odd, the player does not receive a sixth player-directive type 48*b*, corresponding to a not-guilty verdict that is recorded in column 54*e* of Table 54.

If the numerical outcome is even or the offender declines the option to pay the appeal fee, the player receives sixth player-directive type 48*b*, a DWI offense, corresponding to a guilty verdict, including sixth player-directive subtypes 48*c–f* for the appropriate DWI offense. The player records the amount of the fine for sixth player-directive subtype 48*d* in column 54*b* of Table 54, preferably the fines given in Table 48 for sixth player-directive type 48*b* for the appropriate DWI offense. The player also records the number of community service days, preferably the numbers of days given for sixth player-directive subtype 48*e* in Table 48 for the appropriate DWI offense, in column 54*d* of Table 54. The guilty verdict is indicated in column 54*e* of Table 54. If a player (offender) having at least two guilty verdicts rolls an even numerical outcome or declines the option to pay the appeal fee, the player is ejected from the game.

A player receiving fifth player-directive type 46*d* or sixth player-directive subtype 48*c* goes to jail by placing his/her token on indicium 56, located in region 30 of playing surface 4, as shown in FIG. 1. The player may preferably get out of jail by paying a fine, preferably $500.00, using the play money, by playing a get-out-of-jail card from deck 60, or by rolling numerical outcomes 36*a, b*, or *c* or non-numerical outcome 36*g* of FIG. 3 using the pair of dice. If the player is not in possession of the proper deck-60 card, the player may obtain the proper deck-60 card from another player in exchange for play money or in exchange for another deck-60 card in his/her possession. If the player rolls non-numerical outcome 36*e*, that player misses three consecutive turns. The player places his/her token on path segment 22 of FIG. 1 after getting out of jail and resumes play from there.

Upon reaching the assigned end-segment, the player receives a first sum of play money, preferably $500.00. However, the player has the option of increasing the sum of play money by rolling the pair of dice and multiplying the numerical outcome by a second sum of play money, preferably $150.00, that is less than the first sum. If non-numerical outcome 36*e* of FIG. 3 is rolled, the player goes to DWI court, where Table 48 is used as described above. If non-numerical outcome 36*g* of FIG. 3 is rolled, the player has the option of either collecting a sum of play money equal to twice the first sum or rolling the pair of dice and multiplying the numerical outcome by twice the second sum of play money. Now, game play is either ended for the player or the player may initiate another round of play, as described above, starting by drawing a card from deck 52 of FIG. 10 to obtain new start and end path segments. In the case of multiple rounds of play, the players receive twice the first sum of play money, in addition to the first sum of play money, and remove at least one guilty verdict from column 54*e* of Table 54 for each time they reach their assigned end-segment.

After a player has completed the desired number of rounds of play, the game play is over for the player when that player's token reaches his/her assigned end segment for the terminal round. The game is over when all of the players' tokens reach their assigned end segments for the terminal round. At this point, each player pays the fines recorded in column 54*c* of Table 54. Each player also rolls the dice and deducts the number of points equal to the numerical outcome of the dice from the number of points in column 54*b* of Table 54. The player having the largest amount of play money at this point is the winner of the game.

Although the present invention has been described with reference to preferred embodiments, workers skilled in the art will recognize that changes may be made in form and detail without departing from the spirit and scope of the invention.

It is hereby claimed:

1. A game for a plurality of players, the game comprising:

a playing field;

a means, disposed on the playing field, for traversing the field, the playing field traversing means having a plurality of discrete positions, the plurality of discrete positions comprising a set of indicia-bearing discrete positions and a set of non-indicia-bearing discrete positions;

play money;

a means for identifying the discrete position occupied by each player at each instant of play;

a chance means for randomly generating numerical and non-numerical outcomes, the numerical outcomes for at least determining the number of discrete positions to be moved by the position-identifying means during play;

a first means for issuing player-directives in response to indicia born by the set of indicia-bearing discrete positions;

a second means for issuing player-directives in response to the directives issued by the first means for issuing player directives;

a means for assigning each player a discrete-position from the set of indicia-bearing discrete positions for starting the game and a discrete-position from the set of indicia-bearing discrete positions for ending the game;

a means for assigning each player at least one game role;

a third means for issuing player-directives for altering directives issued by the first and second means for issuing player-directives;

a means, remote from the playing-field-traversing means, for temporarily positioning the discrete-position-identifying means according to player directives issued by the second means for issuing player directives; and a means for recording player-directives.

2. The game of claim 1, wherein the of the chance means for issuing numerical and non-numerical outcomes is a pair of dice.

3. The game of claim 2, wherein each die of the pair of dice comprises: four faces bearing indicia representing numerical values of one, two, three, and four, respectively, a face bearing a fifth die-indicium, and a face bearing a sixth die-indicium.

4. The game of claim 1, wherein the first means for issuing player directives comprises a chance means for randomly issuing a player a first player-directive from a plurality of distinct first player-directives.

5. The game of claim 4, wherein the first player-directive issuing chance means is a first deck of shuffled cards.

6. The game of claim 5, wherein the first means for issuing player directives further comprises a chance means for randomly issuing a player a second player-directive from a plurality of distinct second player-directives.

7. The game of claim 6, wherein the second player-directive issuing chance means is a second deck of shuffled cards.

8. The game of claim 7, wherein the first means for issuing player directives further comprises a chance means for randomly issuing a player a third or fourth player-directive from a plurality of distinct third and fourth player-directives.

9. The game of claim 8, wherein the chance means for issuing third- and fourth-player directives is a mixed deck of shuffled cards.

10. The game of claim 9, wherein the mixed deck of shuffled cards includes a third deck of cards comprising the third-player directives and a fourth deck of cards comprising the fourth player-directives.

11. The game of claim 1, wherein the second means for issuing player-directives comprises a chance means for randomly issuing a player a first player-directive from a plurality of distinct first player-directives.

12. The game of claim 11, wherein the first player-directive issuing chance means is a deck of shuffled cards.

13. The game of claim 11, wherein the second means for issuing player-directives further comprises a means for issuing a player a second player-directive from a plurality of distinct second player-directives.

14. The game of claim 1, wherein the position-assigning means includes a chance means for randomly assigning each player a discrete-position from the set of indicia-bearing discrete positions for starting the game and a discrete-position from the set of indicia-bearing discrete positions for ending the game.

15. The game of claim 14, wherein the position-assigning chance means includes a deck of shuffled cards.

16. The game of claim 1, wherein the game role assigning means includes a chance means for randomly assigning each player at least one game role.

17. The game of claim 16 wherein the game role assigning chance means includes a deck of shuffled cards.

18. The game of claim 17, wherein the game role-assigning chance means further includes a pair of dice.

19. The game of claim 18, wherein each die of the pair of dice comprises: four faces bearing indicia representing numerical values of one, two, three, and four, respectively, a face bearing a fifth die-indicium, and a face bearing a sixth die-indicium.

20. The game of claim 1, wherein the third means for issuing player-directives comprises a chance means for randomly issuing a player at least one player-directive, from a plurality of distinct player-directives.

21. The game of claim 20, wherein the chance means for issuing the seventh player-directives is a deck of shuffled cards.

22. The game of claim 1, wherein the means for temporarily positioning the discrete-position-identifying means is a jail indicium disposed on the playing field.

23. The game of claim 1, wherein the discrete position identifying means comprises a token for each player.

24. A game for a plurality of players, the game comprising:

a playing field;

a path, disposed on the playing field, comprising at least a first set of path segments bearing first indicia, a second set of path segments bearing second indicia, a third set of path segments bearing third indicia, a fourth set of path segments bearing fourth indicia, a fifth set of path segments comprising one start-segment for each of the plurality of players, each start-segment bearing a unique start indicium, a sixth set of path segments comprising one end-segment for each of the plurality of players, each end-segment bearing a unique end indicium, a set of blank path segments, and a center path segment, bearing a center indicium, located at the center of the playing field;

at least first, second, third, and fourth regions, disposed on the playing field, each region bounded by a portion of the path;

play money for conducting monetary transactions during play;

a token for marking each player's path segment at each instant of play;

a first chance means for randomly generating a plurality of numerical and non-numerical outcomes;

a second chance means for randomly issuing a player a first player-directive, in response to the first indicia, from a plurality of distinct first player-directives;

a third chance means for randomly issuing a player a second player-directive, in response to the second indicia, from a plurality of distinct second player-directives;

a fourth chance means for randomly issuing a player a third or fourth player-directive, in response to the third and fourth indicia, from a plurality of distinct third and fourth player-directives;

a fifth chance means for randomly issuing a player a fifth player-directive, in response to particular first and second player-directives, from a plurality of distinct fifth player-directives;

a means for issuing a player a sixth player-directive, in response to particular second player-directives, from a plurality of distinct sixth player-directives;

a sixth chance means for randomly assigning each player a path segment for starting the game and a path segment for ending the game;

a jail indicium, disposed on the playing field, for temporarily positioning a player's token according to player directives issued by the fifth or sixth chance means;

a seventh chance means for randomly assigning each player at least one societal role;

an eighth chance means for randomly issuing a player at least one seventh player-directive for altering particular first-, second-, third-, fourth-, fifth-, or sixth-player directives; and a recording means for recording player directives.

25. The game of claim 24, wherein the first chance means is a pair of dice.

26. The game of claim 25, wherein each die of the pair of dice comprises: four faces bearing indicia representing numerical values of one, two, three, and four, respectively, a face bearing a fifth die-indicium, and a face bearing a sixth die-indicium.

27. The game of claim 24, wherein the second chance means is a deck of shuffled cards.

28. The game of claim 24, wherein the third chance means is a deck of shuffled cards.

29. The game of claim 24, wherein the fourth chance means is a mixed deck of shuffled cards.

30. The game of claim 29, wherein the mixed deck comprises a deck of cards having the third player-directives thereon.

31. The game of claim 30, wherein the mixed deck further comprises a deck of cards having the fourth player-directives thereon.

32. The game of claim 24, wherein the fifth chance means is a deck of shuffled cards.

33. The game of claim 24, wherein the sixth chance means is a deck of shuffled cards.

34. The game of claim 24, wherein the seventh chance means is a deck of shuffled cards.

35. The game of claim 34, wherein the seventh chance means further includes a pair of dice.

36. The game of claim 35, wherein each die of the pair of dice comprises: four faces bearing indicia representing numerical values of one, two, three, and four, respectively, a face bearing a fifth die-indicium, and a face bearing a sixth die-indicium.

37. The game of claim 24, wherein the eighth chance means is a deck of shuffled cards.

38. A method for playing a game for a plurality of players, the method comprising:

providing a playing field having a path disposed thereon, the path having a plurality path segments, the plurality of path segments comprising at least a first set of path segments bearing first indicia, a second set of path segments bearing second indicia, a third set of path segments bearing third indicia, a fourth set of path segments bearing fourth indicia, a fifth set of path segments comprising one start-segment for each of the plurality of players, each start-segment bearing a unique start indicium, a sixth set of path segments comprising one end-segment for each of the plurality of players, each end-segment bearing a unique end indicium, a set of blank path segments, and a center path segment, bearing a center indicium, located at the center of the playing field, the playing field also having at least first, second, third, and fourth regions, each region bounded by a portion of the path, the playing field further having a jail;

providing play money for conducting monetary transactions during play;

providing each player with token for identifying the path segment occupied by each player at each instant of play;

providing a first chance means for randomly generating a plurality of numerical and non-numerical outcomes, the plurality of numerical outcomes including at least one set of special numerical outcomes and the plurality of non-numerical outcomes including at least first, second, and third sets of non-numerical outcomes;

providing a second chance means for randomly issuing a player a first player-directive from a plurality of distinct first player-directives, the plurality of distinct first player-directives including at least first, second, and third types of first player-directives;

providing a third chance means for randomly issuing a player a second player-directive from a plurality of distinct second player-directives, the plurality of distinct second player-directives including at least first, second, and third types of second player-directives;

providing a fourth chance means for randomly issuing a player a third or fourth player-directive from a plurality of distinct third and fourth player-directives, the plurality of distinct third player-directives including at least first and second types of third player-directives, and the plurality of distinct fourth player-directives including at least first, second, and third types of fourth player-directives;

providing a fifth chance means for randomly issuing a player a fifth player-directive from a plurality of distinct fifth player-directives, in response to the first type of first or second player-directives, the plurality of distinct fifth player-directives including at least first, second, third, and fourth types of fifth player-directives;

providing a sixth chance means for randomly assigning each player a path segment for starting the game and a path segment for ending the game;

providing a means for issuing a player a sixth player-directive from a plurality of distinct sixth player-directives in response to the second type of second player-directives, the plurality of distinct sixth player-directives including at least first and second types of sixth player-directives, the second type of sixth player-directive including at least first, second, third, and fourth subtypes;

providing a means for players to record at least the second type of second player-directive, the second and third types of fifth player-directives, the first and second types of sixth-player-directives, and the second and third subtypes of the second type of sixth-player-directives;

providing a seventh chance means for randomly assigning each player a societal role;

providing an eighth chance means for randomly issuing a player a seventh player-directive, from a plurality of distinct seventh player-directives, for negating or mitigating a corresponding directive from the first type of first, second, third, fourth, fifth, or sixth player-directives, the second type of second or fifth player-directives, the first, second, third, or fourth subtypes of the second type of sixth player-directive, or the third type of fifth player-directives, as appropriate, or for getting out of the jail;

assigning each player at least one societal role using the seventh chance means;

distributing an identical amount of play money to each player;

assigning each player a path segment on which to place the token at the start of the game and a path segment on which the token will reside at the end of the game using the sixth chance means;

issuing each player at least one seventh player-directive using the eighth chance means;

determining the order in which the players start the game using the first chance means to randomly generate numerical outcomes, the player having the highest numerical outcome going first, the second highest numerical outcome going second, etc.;

initiating a player's turn by generating a numerical or non-numerical outcome using the first chance means;

stopping on a path segment bearing the first indicium;

using the second chance means to randomly obtain a first-player directive;

following the first player-directive;

using the fifth chance means to randomly obtain a fifth player-directive for the first type of first player-directive;

opting to use the seventh player-directive for negating or mitigating a corresponding first type of first player-directive;

stopping on a path segment bearing the second indicium;

using the third chance means to randomly obtain a second-player directive;

following the second player-directive;

using the fifth chance means to randomly obtain a fifth player-directive for the first type of second player-directive;

recording the receipt of the second type of second player-directive using the recording means;

using the means for obtaining a sixth player-directive for the second type of second player-directive;

opting to use the seventh player-directive for negating or mitigating a corresponding first or second type of second player-directive;

stopping on a path segment bearing the third or fourth indicium;

using the fourth chance means to randomly obtain a third or a fourth player-directive;

following the third or fourth player directive;

opting to use the seventh player-directive for negating or mitigating a corresponding first type of third or fourth player-directive;

opting to change at least one societal role with one of the plurality of players or of relinquishing at least one assigned societal role and obtaining at least one different societal role using the seventh chance means for the third type of fourth player-directive;

opting to use the seventh player-directive for negating or mitigating a corresponding first, second, or third type of fifth player-directive, first type of sixth player-directive, or first, second, third, or fourth subtype of the second type of sixth player-directive;

recording the non-negated or non-mitigated first, second, or third type of fifth player-directive, first type of sixth player-directive, or second or third subtype of the second type of sixth player-directive;

going to the jail for the first type of fifth player-directive and the first subtype of the second type of sixth player-directive, in the absence of a corresponding seventh player-directive;

getting out of the jail;

ejecting a player from the game when the player possess more than two of the second types of sixth player-directives;

reaching the assigned end-segment with the token;

receiving a first sum of play money when the token reaches the player's assigned end-segment;

terminating play when all the players' tokens reach the players' respective end-segments; and declaring the winner of the game to be the player having the most play money.

39. The method of claim 38, wherein initiating a player's turn comprises:

moving the token the number of path segments equal to the numerical outcome for a numerical outcome not included in the set of special numerical outcomes;

opting to move the token the number of path segments equal to the numerical outcome or moving the token the number of path segments equal to twice the numerical outcome for a numerical outcome from the set of special numerical outcomes;

fining the player and depriving the player of at least one turn for a non-numerical outcome from the first set of non-numerical outcomes;

depriving the player of at least one turn for a non-numerical outcome from the second set of non-numerical outcomes; or collecting a sum of play money and opting to use the first chance means to generate another numerical or non-numerical outcome for a non-numerical outcome from the third set of non-numerical outcomes.

40. The method of claim 38, wherein getting out of the jail is accomplished by paying a fine using the play money;

obtaining a special numerical outcome using the first chance means; or using the seventh player-directive for getting out of the jail.

41. The method of claim 38, further comprising exchanging at least one seventh player-directive with another player to obtain a needed seventh player-directive.

42. The method of claim 41, further comprising purchasing at least one seventh player-directive from another player to obtain a needed seventh player-directive.

43. The method of claim 38, wherein using a seventh player directive comprises:

relinquishing the seventh player-directive after use and using the eighth chance means to issue at least one new seventh player-directive.

44. The method of claim 38, wherein reaching the assigned end-segment comprises opting to play additional rounds;

using the sixth chance means to obtain new start and end path segments;

receiving twice the first sum of money when reaching the assigned end-segment after each additional round; and removing at least one second type of sixth player-directive from the recording means when reaching the assigned end-segment after each additional round.

45. The method of claim 38, wherein receiving the first sum of play money when the token reaches the player's assigned end-segment comprises:

opting to increase the first sum of play money using the first chance means to generate a first numerical or non-numerical outcome and receiving the product of a second sum of play money, that is less than the first sum of money, and a first numerical outcome from the first chance means for a numerical outcome not included in the set of special numerical outcomes;

obtaining a sixth player-directive using the means for obtaining a sixth player-directive for a first non-numerical outcome from the first set of non-numerical outcomes; or opting to receive twice the first sum of play money or to use the first chance means to generate a second numerical or non-numerical outcome for a first non-numerical outcome from the third set of non-numerical outcomes and receiving twice the product of the second sum of play money and a second numerical outcome.

* * * * *